US007231746B2

(12) United States Patent
Bodnar

(10) Patent No.: US 7,231,746 B2
(45) Date of Patent: Jun. 19, 2007

(54) SHEET METAL STUD AND COMPOSITE CONSTRUCTION PANEL AND METHOD

(76) Inventor: Ernest R. Bodnar, 2 Danrose Crescent, Toronto, Ontario (CA) M3B 3N5

( * ) Notice: Subject to any disclaimer, the term of this patent is extended or adjusted under 35 U.S.C. 154(b) by 436 days.

(21) Appl. No.: 10/765,864

(22) Filed: Jan. 29, 2004

(65) Prior Publication Data

US 2004/0182041 A1 Sep. 23, 2004

Related U.S. Application Data

(63) Continuation-in-part of application No. 10/006,730, filed on Dec. 7, 2001, now Pat. No. 6,708,459, which is a continuation-in-part of application No. 09/907,873, filed on Jul. 18, 2001, now abandoned.

(51) Int. Cl.
*E04C 2/38* (2006.01)
*E04C 3/04* (2006.01)
*E04C 3/08* (2006.01)

(52) U.S. Cl. ..... 52/726.2; 52/729.1; 52/649.1; 52/649.2; 52/649.3; 52/634; 52/635

(58) Field of Classification Search ..... 52/720.1, 52/720.2, 726.2, 729.1, 730.1, 730.2, 736.1, 52/737.1, 633, 648.1, 649.1, 649.2, 649.3, 52/481.1, 634, 636
See application file for complete search history.

(56) References Cited

U.S. PATENT DOCUMENTS 1,994,716 A * 3/1935 Klemperer ..... 52/634
2,088,781 A * 8/1937 Folsom ..... 52/634
3,217,460 A * 11/1965 Downing, Jr. ..... 52/733.3
3,256,670 A * 6/1966 Tersigni ..... 52/634
3,557,511 A * 1/1971 Curran ..... 52/414
4,602,467 A * 7/1986 Schilger ..... 52/319
4,691,493 A * 9/1987 Larsen ..... 52/588.1
4,793,113 A * 12/1988 Bodnar ..... 52/481.1
4,809,724 A * 3/1989 Fuser ..... 135/16
4,885,884 A * 12/1989 Schilger ..... 52/354
4,909,007 A * 3/1990 Bodnar ..... 52/356
5,207,045 A * 5/1993 Bodnar ..... 52/600
5,414,972 A * 5/1995 Ruiz et al. ..... 52/600
5,526,629 A * 6/1996 Cavaness ..... 52/745.19
5,527,625 A * 6/1996 Bodnar ..... 428/595
5,535,569 A * 7/1996 Seccombe et al. ..... 52/634

(Continued)

*Primary Examiner*—Jeanette Chapman

(57) ABSTRACT

Steel studs for use in construction having a web, main web openings through the web, a right angular flange formed on a free edge of the web, and depressions in the web and depression openings in the depressions. An alternate form of stud has a triangular tube structure along one edge of the web. Another form of stud has a discontinuous webs defining spaces between them.

The main web openings may be circular or non-circular. The studs may be used in a composite construction panel having a thin panel of concrete material an embedment angled flange portion formed along the opposite edge of the web, an edge strip formed on the angled flange at an angle thereto; and, spaced apart angled flange openings formed in the angled flange for flow of concrete therethrough The studs form a reinforcing grid of sheet metal studs with embedment portions which are actually embedded into the concrete panel. In one embodiment two concrete panels may be secured to the studs in spaced relation to create a hollow structure.

Also disclosed is a method of forming a composite construction panel.

8 Claims, 12 Drawing Sheets

U.S. PATENT DOCUMENTS 5,669,197 A * 9/1997 Bodnar ..... 52/636
5,687,538 A * 11/1997 Frobosilo et al. ..... 52/731.7
6,115,986 A * 9/2000 Kelly ..... 52/731.9
6,122,888 A * 9/2000 Bodnar ..... 52/745.05
6,263,634 B1 * 7/2001 Bodnar et al. ..... 52/731.1
6,709,459 B1 * 3/2004 Cooney et al. ..... 623/20.11

* cited by examiner

SHEET METAL STUD AND COMPOSITE CONSTRUCTION PANEL AND METHOD

This application is a Continuation-in-Part of U.S. application Ser. No. 10/006,730 Filed Dec. 7, 2001 now U.S. Pat. No. 6,798,459, Title: Sheet Metal Stud and Composite Construction Panel and Method, inventor Ernest R Bodnar, which was a Continuation-in-Part of U.S. application Ser. No. 09/907,873 Filed Jul. 18, 2001 now abandoned, Title: Sheet Metal Stud and Composite Construction Panel and Method, inventor Ernest R Bodnar.

FIELD OF THE INVENTION

The invention relates to a sheet metal stud, for construction of walls, floors, ceilings, and building structures, and in particular to a sheet metal stud adapted to be partially embedded in a thin wall panel of cast material, such as concrete, for reinforcement of such a panel, and to a composite thin wall panel of cast material, such as concrete, having reinforcing studs partially embedded in said panel, and to a method of forming a composite panel.

PRIOR ART

Steel studs of a wide variety have been proposed for erecting structures. Usually such studs are used to replace wooden studs. Concrete panels are also in wide use for attachment to the exterior of a structure to provide for a wide variety of functional and aesthetic effects. Concrete panels are usually of relatively heavy thick material of great weight. Great costs are involved in both materials, labor transportation, and erection of such heavy panels. Proposals have been made for using panels of reduced thickness. Such thin wall panels are reinforced by a framework of metal studs. Usually edges or flanges of the metal studs are partially embedded in the concrete. The studs extend out from the panels and provide great strength to the panels. The studs are usually located at the usual spacings required in the construction of the inside wall and this facilitates the erection and attachment of the wall panels to the structure. Usually the inside surfaces of the resulting walls are covered in with wall sheeting, typically plaster wallboard. The sheeting is often attached directly to the metal studs. The space between the concrete panels and the inner sheeting is usually insulated with suitable batts or the like. However it is known that the metal studs conduct heat from the building interior to the concrete panels and there are thus substantial heat losses through the panels due to such metal studs.

Accordingly studs have been proposed with reduced heat transfer properties. These studs were formed with generally triangular or trapezoidal openings. The orientation of alternate adjacent openings was reversed. In this way the openings were positioned so as to define between them diagonal struts extending across the studs. Heat could pass along the struts but not where there were openings. Heat losses across the stud were thus reduced since there was less metal through which the heat could pass. However when these panels are erected, it is usual for the builder to run services through the studs, within the wall. Where the openings are of these specialized shapes the services must be such that they can fit the openings, and all openings is all the studs in a wall would preferably be aligned with one another to facilitate the passage of services therethrough. It is not possible to the builder to cut away any of the diagonal struts to provide larger openings for services, since this would drastically reduce the strength of the studs.

Another problem arose in that the triangular openings were formed with edge flanges around their perimeter. It is desirable that the edge flanges shall be formed substantially into a right angle bend relative to the plane of the sheet metal. This right angle bend increases the strength of the overall stud. However where these edge flanges extended around an angular corner of the generally triangular or trapezoidal shaped opening there was a tendency for the sheet metal in the edge flange to crack. Consequently the corners had to be radiussed or rounded out. This meant that there was more metal at each of the corners, than was desirable for heat transfer, and thermal losses could occur. Also at these angular corners it was found that it was not possible to bend or form the edge flanges of the struts in the studs into a full right angle bend. Instead the angle of the flanges at the corners was something less than a right angle. This was found to reduce the problems of cracking of the sheet metal at these corners. However this solution was not totally satisfactory since, by reducing the angle of the edge flange, the strength of the overall stud was also reduced.

Another problem arose in cutting these studs to length. As explained above the openings were arranged in pairs, in which the orientations of the two openings was alternately reversed, with one triangle facing one way and the next facing the opposite way. Construction practices for such studs require that all of the openings of a particular orientation, in all of the adjacent studs in a wall frame, shall line up. This is required to facilitate passing of services through the studs. However due to the alternating orientation of the openings there were problems in cutting off the studs to a specific length. This was done as part of the manufacturing process, on the production line. If cutting was carried to a specified length which was not an exact multiple of the spacing of the openings then the cutting step resulted in cutting off waste end portions of studs equal in length to the space occupied by two openings, in many cases. This was waste metal and increased the cost of the building.

It has now been surprisingly found that the use of the specialized trapezoidal shapes of these stud openings, defining diagonal struts, is not always necessary. In fact a reduction of heat transfer across the stud is possible using circular openings in the studs. In other cases the openings can be made which are not completely circular, but have rounded corners and some more or less straight sides. In this case the corners could be rounded out over a much greater radius than was formerly used. One of the corners may even be semi-circular. This was not thought to be possible since circular openings, or openings with long radius corners, or semi-circular corners would leave excessive metal in the stud which would still cause heat transfer losses. While this would appear to be correct, in theory, it has been found that by the use of relatively small additional openings, the actual heat transfer path can be so reduced, at critical points in the stud, so as to substantially improve on the heat transfer reduction achieved by the use of the specialized triangular or trapezoidal openings and diagonal struts of earlier studs, and could be generally equivalent to the heat transfer curves of wooden studs.

Circular openings, or openings with rounded corners, avoid the problems caused by the corners of the triangular or trapezoidal openings and splitting of metal, and results in a much stronger stud. The use of circular or rounded openings greatly facilitates high speed manufacture of such studs by punching out circular blanks, or blanks with semicircular corners, from the sheet metal. This leads to economies from higher production speeds.

The blanks of sheet metal removed in this process provide secondary products of a more convenient shape. This leads to economies in the process since the blanks can be remanufactured into secondary products and can thus be sold instead of being discarded as waste. In the case of completely circular openings the cutting to length of such studs becomes easier since every opening is the same shape and the same spacing along the stud. This leads to economies in manufacture since the studs can now be cut to length with less wastage of material than was possible in the past. Most importantly, the circular or semi-circular openings remove many of the problems for the builder who wishes to pass services through the studs within the wall. Much larger diameter pipes can now be fed through the studs, than was possible with studs using trapezoidal openings. This leads to less sales resistance due to a greater acceptance of the product in the market place. Finally, cutting to length of a stud with identical circular openings may result in much less wastage of material and this is another cost saving.

It will be appreciated that a stud which improves on all these problems associated with prior studs, will have application in general use, apart from the reinforcement of a concrete panel. Such a general purpose stud will have minor modifications from the panel reinforcement stud, but will be otherwise similar.

BRIEF SUMMARY OF THE INVENTION

The invention provides a plurality of general purpose studs for use as a replacement for conventional studs in walls, floors, roofs and the like. Such general purpose studs will be similar to several embodiments of reinforcement stud as described below, but without an embedment flange or portion capable of being embedded in a concrete cast panel.

The invention further provides such a stud which has a web, and web main openings of generally non-triangular shape formed through said web, and longitudinal free edge flanges, and edges of said main openings being formed out of the plane of said web to define a continuous reinforcing ring like wall around said main openings.

The invention also seeks to provide a composite construction panel and comprising, a thin panel of concrete material, a reinforcing grid of sheet metal studs comprising parallel studs and top and bottom members, wherein said studs have embedment portions which are actually embedded into the concrete panel, and wherein each of said studs comprises, a web defining a free edge, right angular flange formed on said free edge, an angular edge strip formed along the free edge of said right angular flange, an embedment flange portion formed along the opposite edge of said web, a retention edge strip formed on said embedment flange portion at an angle thereto, and, a plurality of spaced apart embedment flange openings formed in said angled flange.

The invention further provides such a composite construction panel wherein said embedment flange openings are formed by a series of semi-arcuate openings located spaced apart lengthwise along said embedment flange.

The invention further provides such a composite construction panel and including web main openings of generally circular shape formed through said web between said embedment flanges and said free edge flanges, and edges of said circular openings being formed out of the plane of said web to define an annular ring.

The invention further provides a reinforcing stud for use in forming a composite construction panel wherein the panel is formed in a thin panel of cast material such as concrete type material, and a reinforcing grid of sheet metal studs wherein said studs have embedment portions which are embedded into the panel, and wherein each of said studs comprises, a web defining a free edge, right angular flange formed on said free edge, an angular edge strip formed along the free edge of said right angular flange, an embedment flange portion formed along the opposite edge of said web, a retention edge strip formed on said flange portion at an angle thereto and, a plurality of embedment openings formed longitudinally spaced apart along said embedment flange portion.

The invention further provides such a reinforcing stud wherein said embedment openings are formed by a series of semi-arcuate openings located spaced apart lengthwise along said embedment flange portion.

The invention further provides such a reinforcing stud, in one embodiment, including main web openings of generally non-triangular shape with radiussed corners formed through said web between said embedment flange portions and said free edge flanges, and edges of said main openings be formed out of the plane of said web to define ring walls around said main openings.

The invention further provides such a reinforcing stud, in another embodiment, including main web openings of generally non-circular shape formed through said web between said embedment flange portions and said free edge flanges, in which the non-circular main web openings define corners have long radius curvature, and one of said corners being substantially semi-circular, and edges of said non-circular openings be formed out of the plane of said web to define generally right-angular edges flanges.

The invention provides a further form of such a stud which is formed with generally circular indentations or depressions in the sheet metal locations spaced from said main openings, and openings formed in said depressions.

The invention provides a further form of such a stud which is formed with a tubular formation along the free edge.

The invention provides a further form of such a stud which is formed without a continuous embedment flange portion. In this embodiment the web is formed as a series of generally V-shaped web portions with spaces therebetween, and with embedment formations at the apex of each V-shaped web portion.

The invention provides a further form of such a stud which is formed with small circular indentations or depressions with openings in the indentations, and in which each opening in each such small indentation is formed edge portions of sheet metal within the small indentations or depressions.

The invention provides a further form of such a stud which is formed with non-circular main openings, having at least one first radius corner formed as an arc of a circle having a first radius, and with two further lesser radius corners formed as arcs of circles having radii less than said first radius.

The invention provides a further form of such a stud which is formed with non-circular main openings as aforesaid and in which circular indentations or depressions are formed in the sheet metal alternately spaced further apart and closer together adjacent said first radius corner and said lesser radius corners respectively, the small depressions having openings formed therein defining arcuate sheet metal portions on sides of such opening.

The invention provides any of such studs, being formed with an embedment flange along one edge having embedment openings in such embedment flange for embedment in a panel of cast material, whereby any of such studs may be used to form reinforcing for a reinforced cast panel.

The invention provides any of such studs, in which the openings in the small depressions are formed with edge flanges, the edge flanges being formed in a direction opposite to the axis of the depression.

The invention provides any of such studs, in which the right angular flange is formed with a folded strip, to form a double thickness of sheet metal, in the folded strip.

The invention further seeks to provide a method or making a composite construction panel comprising the steps of, assembling a plurality of reinforcing studs, each having webs with circular or non-circular main openings therethrough, in parallel spaced apart relation with said main openings aligned with one another, and with cross members arranged transversely at the ends of said parallel studs thereby forming a grid of studs, said parallel studs having embedment flange portions thereon, pouring cast material such as concrete into a form shaped to provide a planar panel, placing reinforcing mesh in said cast material, placing said grid of studs over said cast material in said form and lowering the same until said embedment flange portions are immersed in said cast material, allowing said cast material to cure, and removing said formed composite panel consisting of cured cast material with said grid of studs secured in and extending from said panel.

The invention further provides a plurality of general purpose studs for use as a replacement for conventional studs in walls, floors, roofs and the like. Such a general purpose studs will be similar to the several embodiments of reinforcement stud described above, but without the embedment flange portion.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
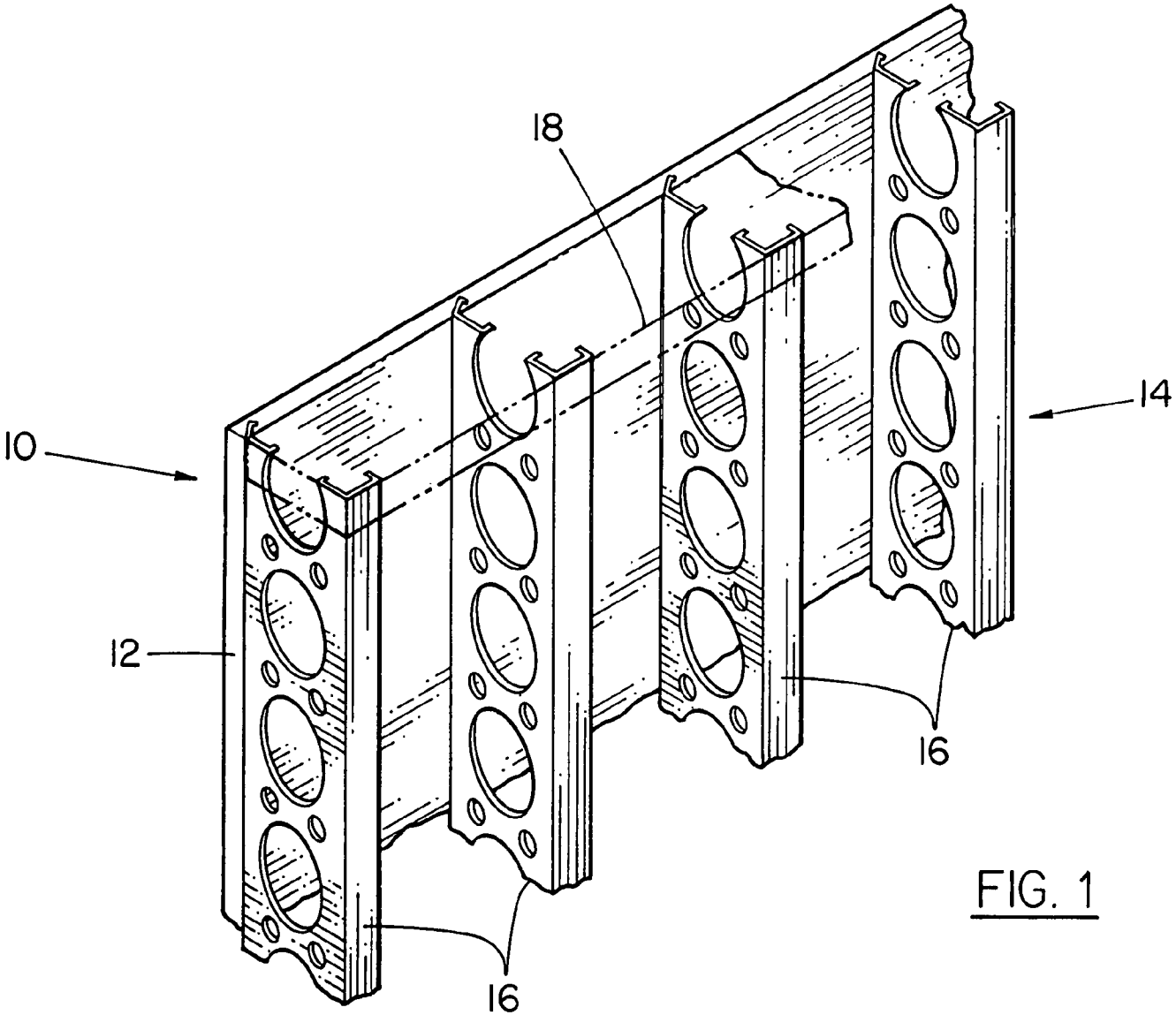
FIG. 1 is a perspective general illustration of a typical thin wall panel of cast material such as concrete, of the type to which the invention relates illustrating the reinforcing frame of sheet metal studs partially embedded therein.

Referring first of all to FIG. 1 it will be understood that one aspect of the invention relates generally to a composite wall panel 10 typically looking somewhat like the illustration of FIG. 1. Such a composite panel 10 has a thin panel 12 of cast material, and a reinforcing frame or grid indicated generally as 14, formed of sheet metal studs indicated generally as 16. Typically the cast material is concrete, but various special forms of concrete are available, which would be suitable for the purpose. However the invention is not limited to concrete materials as such, but includes other panel materials which are capable of being cast into a thin panel and allowed to cure. As will be explained below such studs have embedment portions which are embedded into the concrete 12.

Typically the studs 16 may be arranged on twenty-four inch centers, and may have top and bottom transverse studs 18 joining the top and bottom ends of the studs 16. The top and bottom studs will usually be plain C-section studs, for the sake of simplicity in assembly.

Stud reinforced panels of earlier designs have been known, in general, for some years. However they have suffered from various defects, and have not achieved wide acceptance in the market place in spite of their great advantages in theory.

Some such panels were made with studs which had undesirable and excessive heat transfer characteristics. This resulted in heat transfer through the studs to the exterior of the building and in cool weather produced cold spots on the interior wall, along the line of each stud.

Condensation or so-called "ghosting" lines would then occur along the lines of the studs.

Other panels were made with studs which were of a highly technical design. Such studs had reduced heat transfer, but required great care in design and manufacture to provide adequate strength for reinforcing such a panel. In addition the design of such studs made it difficult to pass services through the studs within the wall. Such studs were complex in design and manufacture of the studs was time consuming and wasteful of material.

Figure 2:
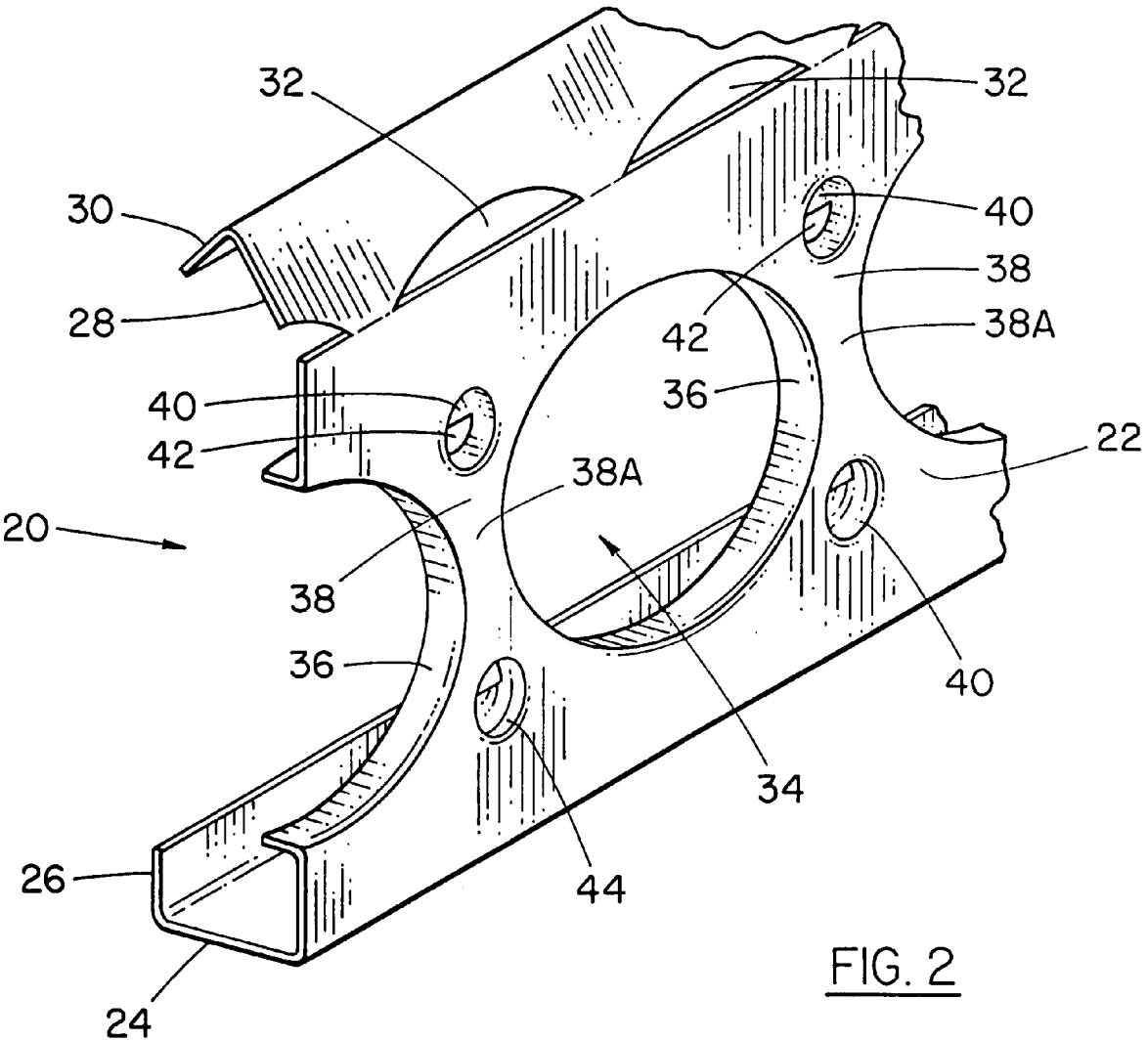
FIG. 2 is a partial perspective of an embodiment of sheet metal reinforcing stud for use with a panel such as the panel of FIG. 1.
Figure 4:
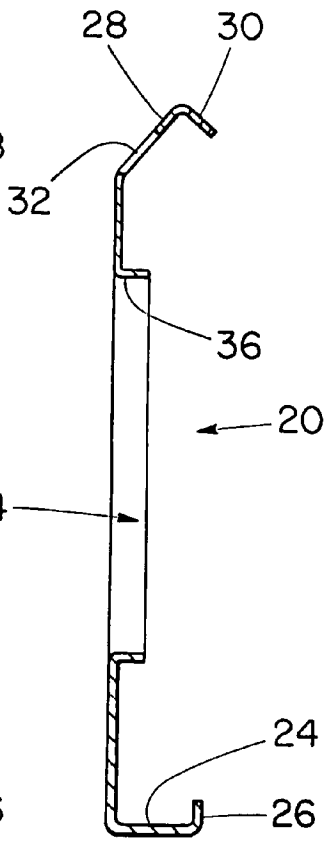
FIG. 4 is a section along line 4—4 of FIG. 3.
Figure 3:
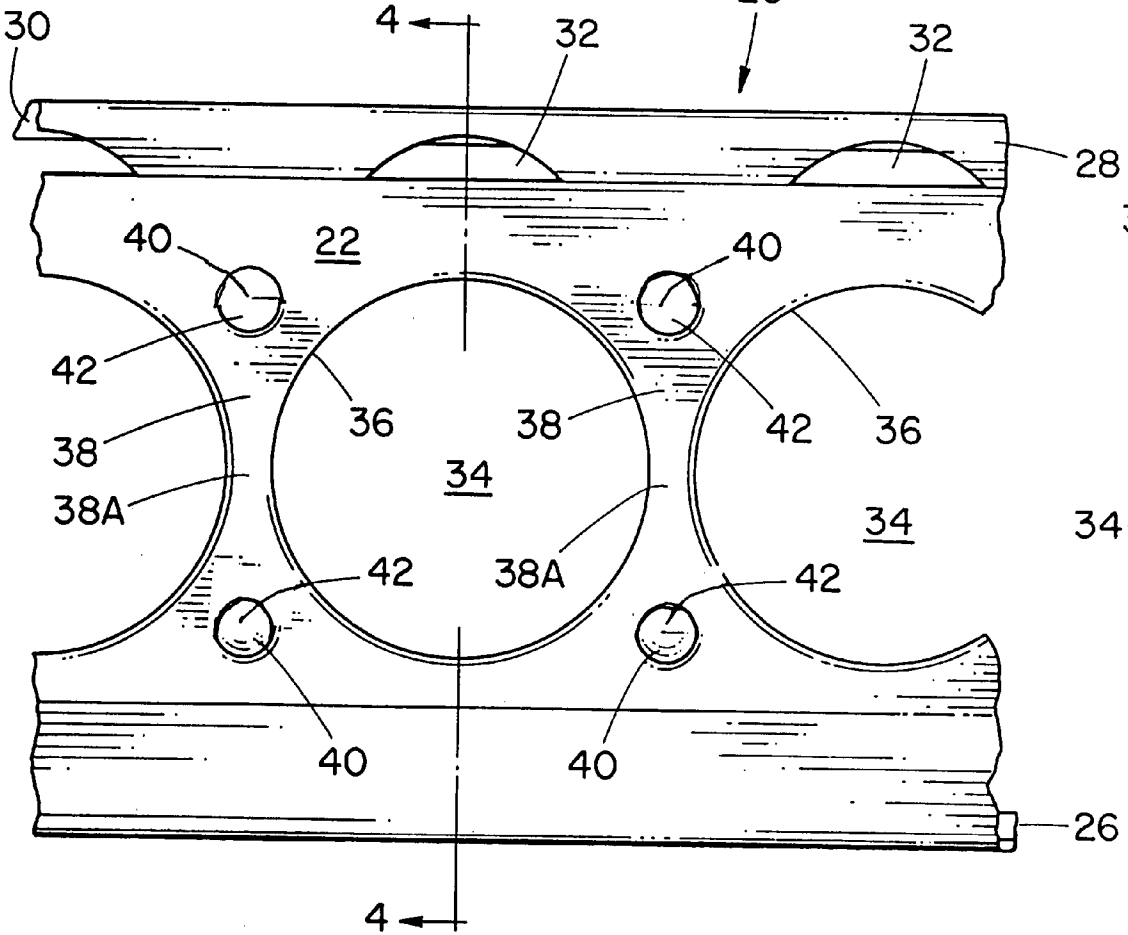
FIG. 3 is a side elevation of the stud of FIG. 2.

In accordance with one embodiment of the invention, as shown in FIGS. 2, 3 and 4, one preferred form of stud 20 is shown by way of illustrating the invention.

The stud 20 has a web 22, of whatever width is desired for the particular application. Along one edge of the web, the "free" edge, ie the edge that will be remote from the concrete panel, there is formed a right angular flange 24. Typically a further angular edge strip 26 is formed along the edge of flange 24, for added stiffness. Along the opposite edge, the "embedment" edge, of web 22, there is formed, in this case, an embedment flange portion 28 formed at obtuse angle, in this particular embodiment, and having a retention edge strip 30 at an angle to flange portion 28.

Preferably strip 30 makes an acute angle relative to flange portion 28, so as to form a type of partial "hook" formation, for secure retention in the panel.

The apex of the embedment flange portion 28 and retention strip 30 will usually be about ¾ of an inch from the edge of the web for reasons to be described below.

However these measurements are merely an indication of what might be typical and are without limitation.

Along the length of embedment flange portion 28 there are formed a plurality of spaced apart openings 32. Openings 32 are formed as struck out portions of sheet metal. In this case the struck out portions will leave openings 32 which will have one straight edge and one generally arcuate edge. Thus they will form openings 32 of a semi-oval shape.

They are relatively long and wide so as to permit material, such as concrete and aggregate to flow readily through such openings during assembly as described below. The straight edge portion of the openings 32 may in fact extend partially into the web 22 itself.

Between the flanges 24 and flange portions 28, there is defined the central portion of the stud known as the web 22. The sheet metal of which the whole stud is formed has a relatively high rate of heat conduction, much greater than that of a conventional wooden stud, for example.

As already explained earlier forms of stud were formed with openings through the web of a complex geometrical shape, leaving diagonal strut portions extending across the web between the flanges. It was thought that by forming these struts along diagonal lines, that the heat conduction path would thus become elongated, and therefore lead to a slower rate of heat conduction across the web. These shapes were to some extent disadvantageous since they required careful engineering of the diagonal struts, particularly at their opposite ends in order to withstand shear forces across the stud. Because the openings were generally triangular in shape they formed relatively sharp corners. The edge lips on the cross members had to be substantially reduced at these corners, to eliminate splitting of the metal during forming.

It has now been surprisingly found that the rate of heat conduction can be slowed down to the same, or to a greater degree, without forming diagonal struts and complex shaped openings in the web.

In accordance with the invention the web is now provided with a series of openings 34 spaced apart along the web 22 at regular equal intervals. These openings in one case may be formed simply by punching out shaped blanks of metal from the web.

The blanks clearly provide an opportunity for secondary manufacture of unrelated products, thus avoiding wastage of sheet metal.

Around each of the openings 34 the edges of the sheet metal are formed over into generally right-angular flanges 36, which define ring-walls more or less at right angles to the plane of web 22. These have the effect of enlarging the area of each opening, and also adding stiffness to the stud. Because there are no sharp angles, around the openings, the bent over edge flanges or rings 36 define a smooth continuous curve. It is thus possible to provide deeper edge flanges than was possible with the diagonal strut stud, with triangular openings. This provides greater stiffness.

Between each opening 34 there is defined a transverse web portion 38 which is of generally hourglass shape. The narrowest part of the web portion 38 is clearly at its mid point 38A. This narrow area will define one area of heat transfer reduction, since clearly the actual mass of sheet metal is least at this point, and heat flow at any given temperature gradient is a function of the mass of the conductor.

In order to increase still further the stiffness of the stud, generally annular depressions 40 are formed in the web, at each end of each of the transverse web portions 38. In order to further slow down the rate of heat transfer, openings 42 are formed in depressions 40. In this way by removing these small portions in the depressions 40 to leave openings 42 located at each of the ends of the web portions 38, the heat transfer path is narrowed once again towards each end of the web portions 38, on either side of the openings 42. This also results in creating generally sinusoidal heat transfer paths, which are thus longer than a direct line from side edge to side edge of the web. These factors still further slow down the rate of heat transfer.

The end result is a metal stud which has heat transfer characteristics close to that of a wooden stud. Such openings 42 may be circular as shown in FIGS. 1 and 2, or may be semi-circular, in some cases.

Studs made in this way have numerous advantages. They can be manufactured more readily than more complex shaped studs.

The needed engineering characteristics of the studs can be more readily achieved. The manufacturing process is simpler. The process produces less waste material, and by using the blanks for secondary products the waste is reduced. Given suitable machines the secondary products could in fact be stamped out as part of the whole manufacturing process of the studs themselves.

The studs are easier to use since they can be more readily be cut to length than more complex studs, and with less wastage. The circular openings in the studs are much more suitable for construction techniques, since is becomes possible to pass relatively large services through these openings.

For some applications it may be desirable to provide a stud of greater strength.

Figure 6:
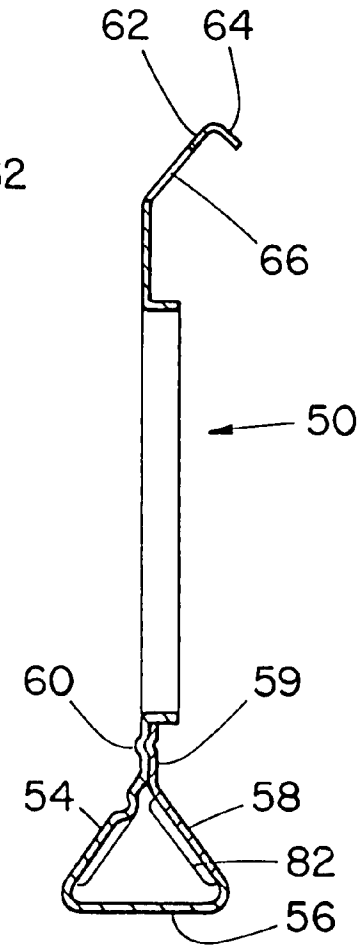
FIG. 6 is a section along line 6—6 of FIG. 5.
Figure 5:
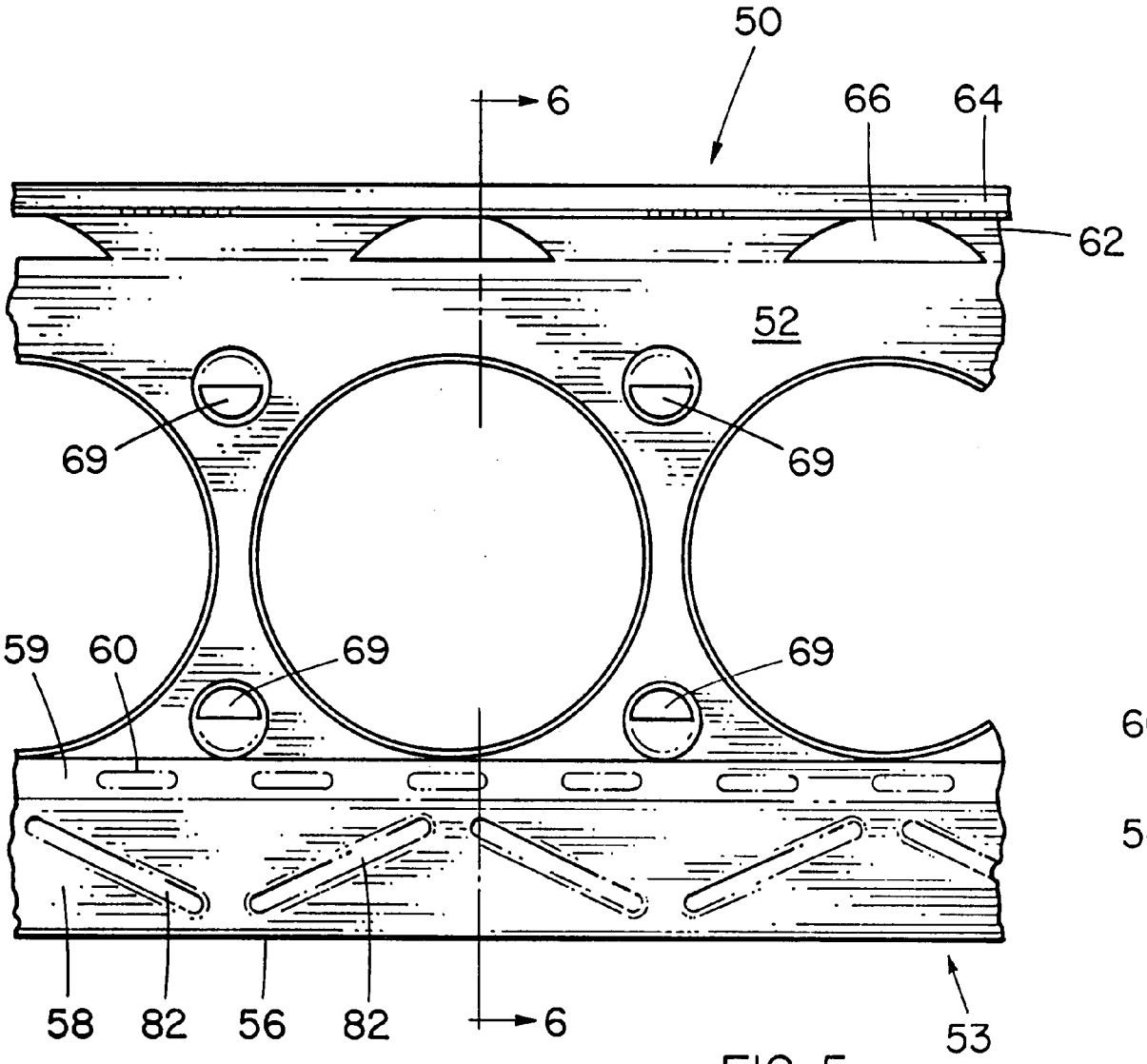
FIG. 5 is a side elevation of a further embodiment of sheet metal reinforcing stud for use where greater loading bearing is required.

In this case the stud of FIGS. 5 and 6 may be used.

In this case a stud 50 is shown having a web 52, and, along one side a generally triangular tubular edge formation 53 is formed, comprising, and first angled tube wall 54, a transverse tube wall 56, and a return tube wall 58. The three tube walls are formed integrally with the sheet metal of the web. The free edge 59 on return tube wall 58 is secured back to web 22 by any suitable means, indicated generally as 60. This could be by spot welding, or by a technique known as "metal stitching". In this latter process a punch is forced into the two sheets of sheet metal. A female die opposite the punch receives the formed portions of sheet metal and allows them to expand outwardly, thus forming something like a rivet in the two pieces of sheet metal making a secure bond between the two portions of sheet metal. Another technique is simply to punch out tongue portions (not shown) from both the web and the return flange, and then simply fold the two tongue portions back over themselves, as at 61 (FIG. 6), substantially as shown in U.S. Pat. No. 5,592,848.

Along the opposite edge of the web 52 an embedment flange portion 62 is formed, in this case at an angle to the web 52. An acute angle retention edge strip 64 is formed on flange portion 62. Embedment openings 66 are formed in flange portion 62 as in the embodiment of FIGS. 2, 3 and 4.

In the use of either the embodiment of FIGS. 2, 3 and 4 or of FIGS. 5 and 6, the studs are assembled into a grid similar to that shown in FIG. 1 and the ends of the studs are secured in any suitable manner. Usually top and bottom studs are used to hold all the studs into a framework. The top and bottom studs can be simple C-sections, for convenience.

A thin layer of cast material, such as for example, concrete, is then poured into an open topped mold or form. The mold or form will define the size and shape of the finished panel. In one typical case the layer of cast material may be about 1½ inches thick, although this may vary significantly from one job to another. Concrete, or other such materials as thin as ½ inch total may be suitable in some cases. The usual reinforcing steel mesh will be attached to the embedment edges of the grid of studs. The grid of studs with the mesh attached is then brought over the open topped form, with the angled flanges 28 or 62 facing downwards. The grid, and mesh attached thereto, is then lowered down to the material in the form. The mesh and the angled flanges 28 or 62 are then pressed down through the surface of the material. This will also cause the mesh and the edge strips 30 or 64 to be completely submerged in the cast material, such as concrete.

This will allow the still semi-liquid cast material to flow through the embedment openings 32 or 66, in the angled flanges 28, or 62.

The cast material such as concrete is then allowed to cure and set.

The entire composite panel can then simply be lifted out of the form by attaching lifting gear to the grid of studs.

The panel may then be transported to a work site. The panel can then be raised into position and secured to the building fabric, by securing the grid of studs to the existing building.

Once in place the panel covers the exterior of the building, and the grid of studs provide the support for placing insulation batts (not shown), and dry wall panels (not shown) for finishing the interior walls of the building.

Clearly, if desired, similar or modified panels can be made of lighter gauge materials. Materials other than conventional concrete can be used with advantage By using modified light weight concrete, or special high strength concretes, the panel weight can be reduced. With some such materials it is possible to provide a panel without the use of reinforcing mesh at all. This will permit the use of such panels for finishing interior walls of the building. Special exterior finishes can be cured in place with the cast panel.

Simulated brick veneers can be placed in the form before the material is poured. They will then form the exterior finish of the building on which the panels are erected. The system can also be used for making hollow structures, in which two thin wall panels are formed on opposite sides of a grid of studs.

Such structures can be used for floors and ceilings and roofs, or for making more substantial building walls if such are desired. If heavier gauge studs are used these structures can be used as load bearing walls in themselves. This will eliminate the need for pouring building columns and floors, at least in lower buildings.

If desired concrete or other such materials can be poured into the interior of the hollow structure, at intervals, thus providing what are in effect cast columns (not shown), to give still further load bearing capacity.

Figure 7:
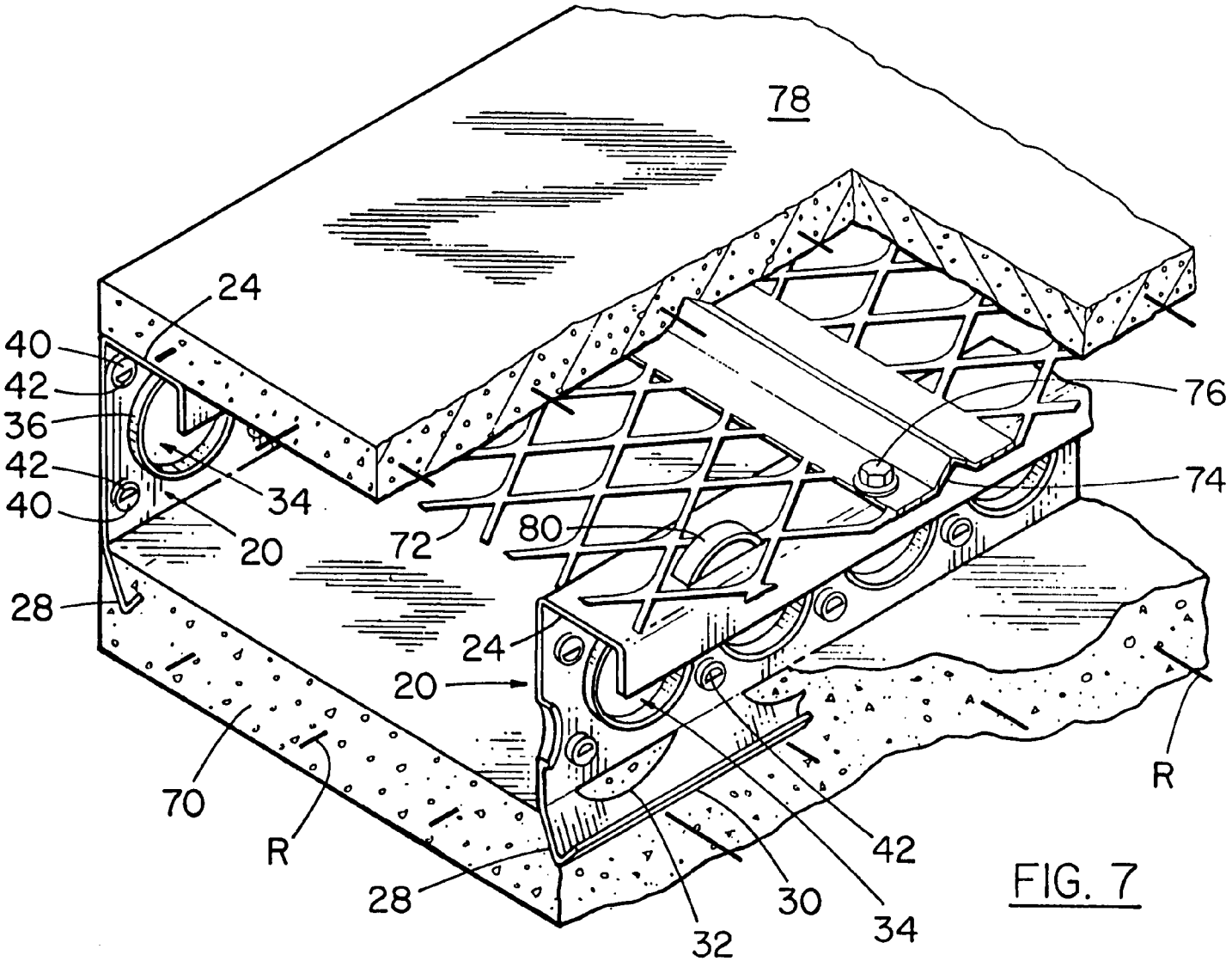
FIG. 7 is a schematic perspective of a further embodiment of cast panel, in this case there being two such panels poured on opposite sides of the reinforcing frame, to provide a two panel wall construction.

Such an embodiment is shown in FIG. 7.

In this case studs similar either to the FIGS. 2, 3 and 4 embodiment, or for greater strength, to the FIGS. 5 and 6 embodiment, are used, as before. Their embedment flange portions 28 or 62 are embedded in a thin-wall panel, such as concrete, indicated as 70, as already described.

On the free exposed flanges 24 or transverse tube walls 56 a layer of metal furring of expanded mesh 72 of a type well-known in the art, and having spaced apart attachment strips 74 formed integrally therewith, is secured by for example bolts 76, or any other suitable fastening system.

A second thin-wall layer of material, such as concrete, 78 is then poured directly onto the mesh 72. The material will flow into the openings in the mesh and will form an effective bond securing the cured material in position, attached to the grid of studs. The composite structure formed by combining a second panel spaced from the first panel 70 defines a hollow wall structure of great strength supported internally by the grid of studs.

For added security the flanges 24 (or transverse walls 56) of the studs may be formed with locking loops 80. Loops 80 are formed simply by forming two parallel incisions in the flange and then forming the metal outwardly into loops as shown (FIG. 7).

The loops will embed securely in the panel and make a secure bond.

It will be appreciated that the studs may be formed of lighter gauge sheet metal for some applications, and heavier gauge for other applications. Similarly the specifications of the studs may vary from one application to another. For flooring, using the composite spaced panels of FIG. 7, studs of up to say 14 inches in depth may be desired in some case, and made of say 12 gauge metal. This will provide great savings in material cost, and savings of costly down time on site, which are normally experienced while thick concrete slab floors are poured and then allowed to cure.

Such composite floors panels can be preassembled with all wiring and ventilation duct work, and plumbing pipes and fittings, in place, in a factory, under controlled conditions using mass production practices.

For walls however studs of say 2½ to 8 inches width may be used and formed of 12 to 24 gauge metal. For interior building partitions much lighter specifications may be used, and still produce building partitions superior to conventional building partitions made of two layers of dry wall in the conventional manner. Interior partitions made in this way will have the great advantage that they can be made in a secure factory location, and completely finished, and even dry walled and painted if desired, before they are brought to the actual building site.

Thus factory labor and mass production practices can replace costly on site labor conventionally used for covering in and plastering and painting walls.

For adding still further strength to the studs of FIGS. 5 and 6 the angled walls 54, and the return walls 58 may be formed with indentations 82 at spaced intervals there along. These indentations may be in a zig zag diagonal pattern as shown or any other pattern suitable for the purpose.

Figure 8:
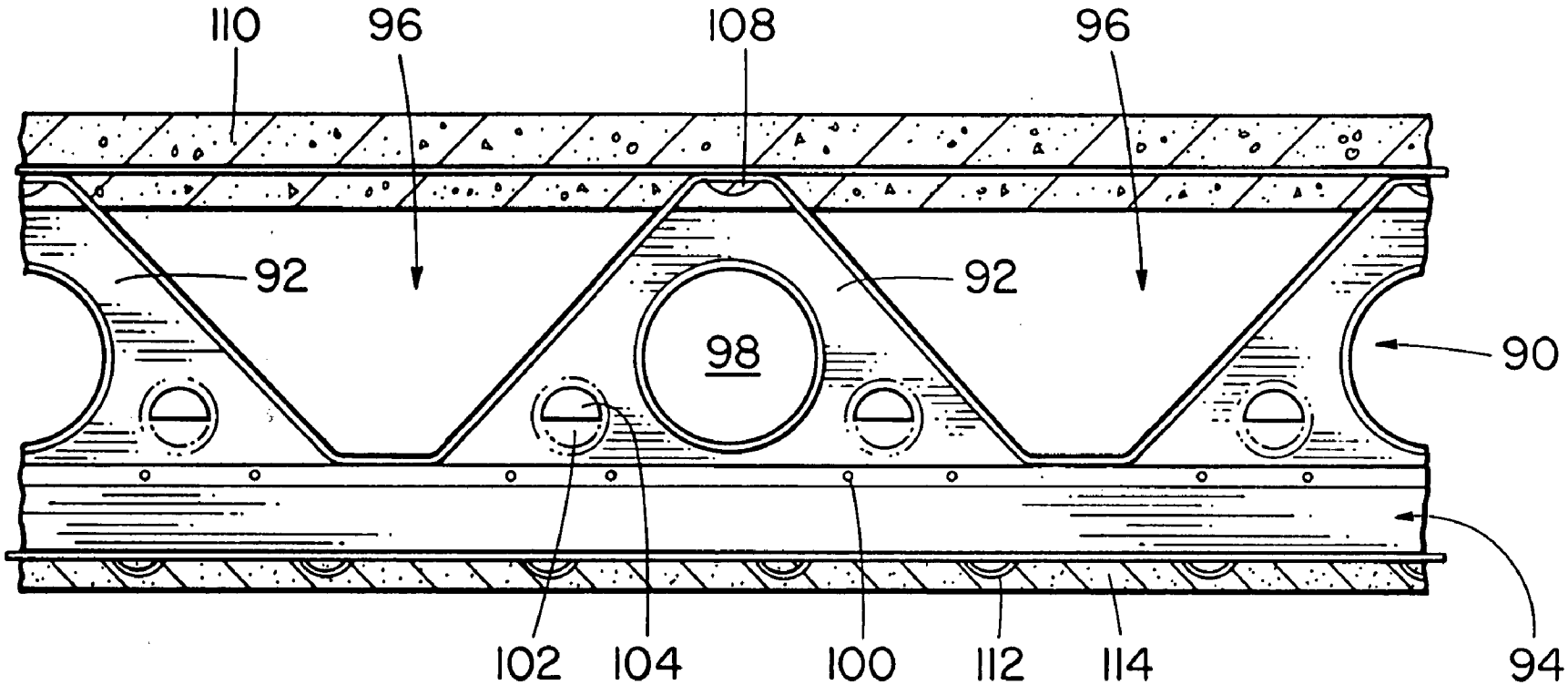
FIG. 8 is a section of a further alternate embodiment of stud shown used in the assembly of a two-panel structure, similar to FIG. 7.

A further embodiment of stud is shown in FIG. 8. This stud will typically be used in fabricating a two-panel spaced structure similar to FIG. 7. In most cases this stud would be used for somewhat lighter duty applications, although it could be made of heavier gauge metal for greater loads.

In this embodiment the stud 90 has a series of generally triangular shaped webs 92 all of which extend from a generally tubular edge formation 94. Between the webs 92 are defined generally inverted triangular spaces 96. The webs and the spaces are not truly triangular since the apex of each web 92 is flattened, and the apex of each space is elongated and linear. The word "triangular" is therefor used here as suggesting the general shape, without being in any way limiting to a specific triangular definition.

The tubular edge formation 94 is formed in the same way as the tubular edge section 53 of stud 50 of FIGS. 5 and 6. The details are not illustrated since repetition is unnecessary.

Each of the webs 92 is formed with a larger circular opening 98, formed with an annular edge flange (not shown) as in the case of the previous embodiments.

At the wider base edge of each web 92 two smaller depressions 100 and 102 are formed for added stiffness. A semi-circular opening 104 is formed in each depression 100 and 102 as in the earlier embodiments. The apex of each web 92 is formed with a flattened linear embedment formation 106, and semi-arcuate embedment openings 108 are formed through the webs 92 for passage of concrete and aggregate, for locking the apex formation 106 of each web 92 securely in a panel of concrete 110. Locking loops 112 and formed along tubular edge formation 94 as in the case of the FIGS. 5 and 6 embodiment. These loops will extend into the second panel of concrete 114 for locking in place. Furring mesh (not shown) would usually be attached to tubular edge formation 94, much the same as shown in FIG. 7.

It will be appreciated that in the foregoing description the embedment flange portions 28 or 62 and the retention edge strips 30 or 64, have been described and shown as bent at defined angles. This is simply to provide added stiffness.

Figure 10:
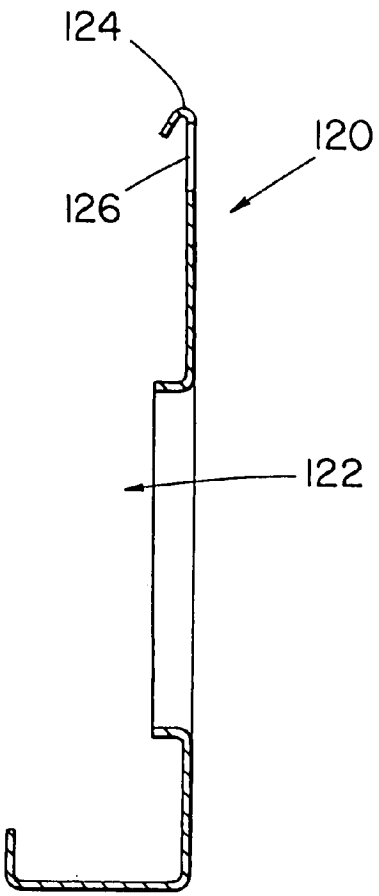
FIG. 10 is a section of the embodiment of FIG. 9.
Figure 9:
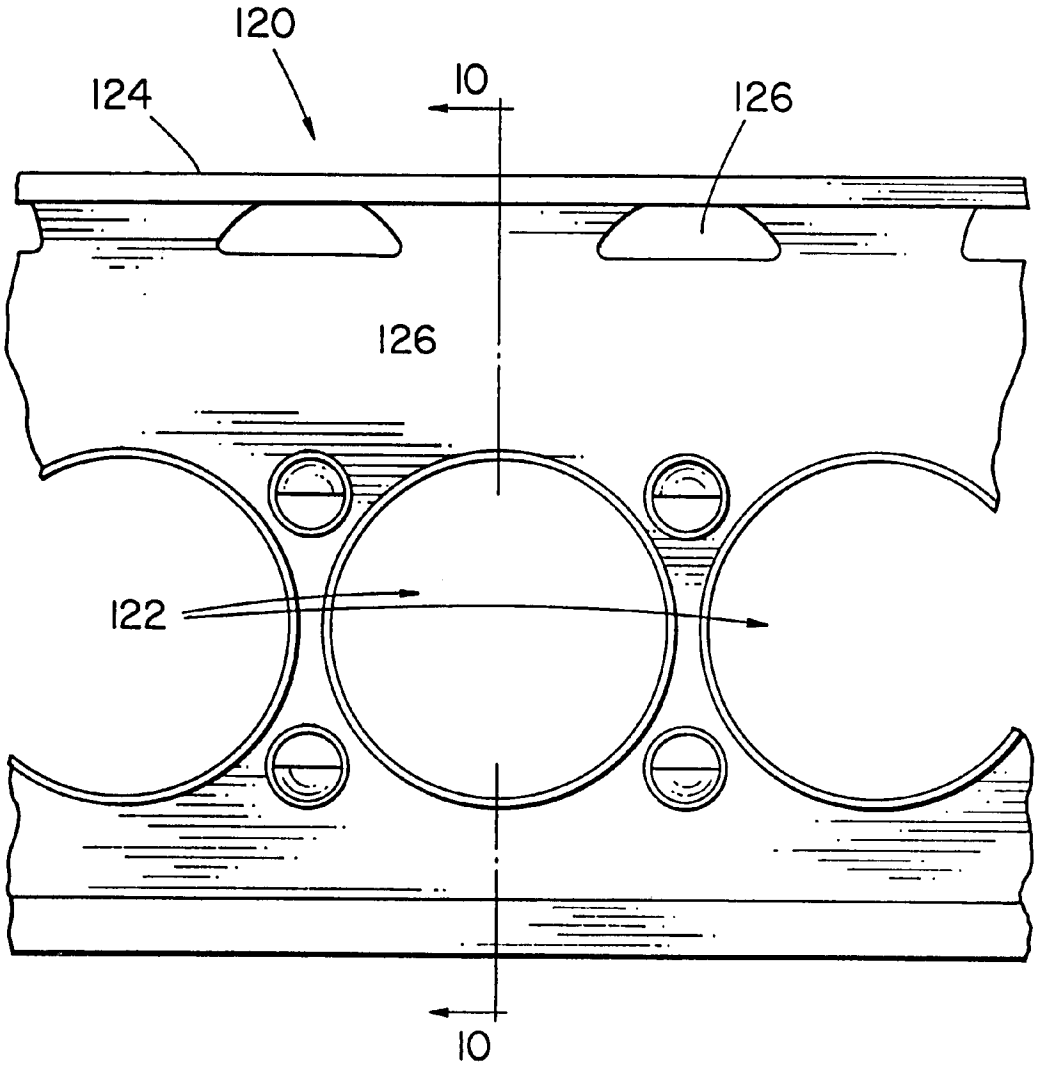
FIG. 9 is a side elevation of another embodiment of stud showing a modified edge flange.

In many cases these two features could be made as a simple continuous radius. Such a feature is shown in FIGS. 9 and 10.

The stud 120 has the same large openings 122 and indentations and small openings as the studs of FIGS. 2, 3, 4, 5, and 6.

However the embedment flange portions and retention edge strips are formed by the smoothly curved radius bend portion 124, having openings 126 along its length.

The studs described are intended for use in reinforcement of concrete panels in the manner described above.

However it will be understood that with minor modifications studs of this type may be made for use as general purpose studs, for use in construction, for example of walls, floors, ceilings and the like, whether such concrete panels are used on the building exterior or not.

Figure 12:
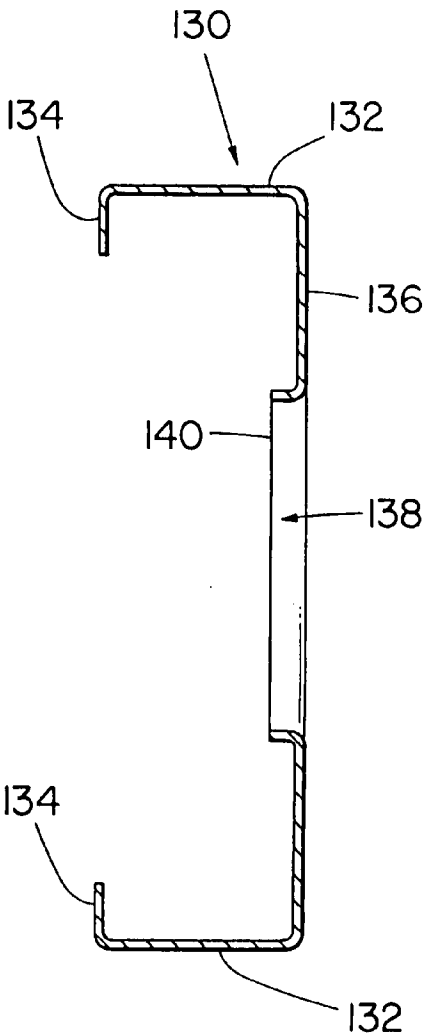
FIG. 12 is a section of the embodiment of FIG. 11.
Figure 11:
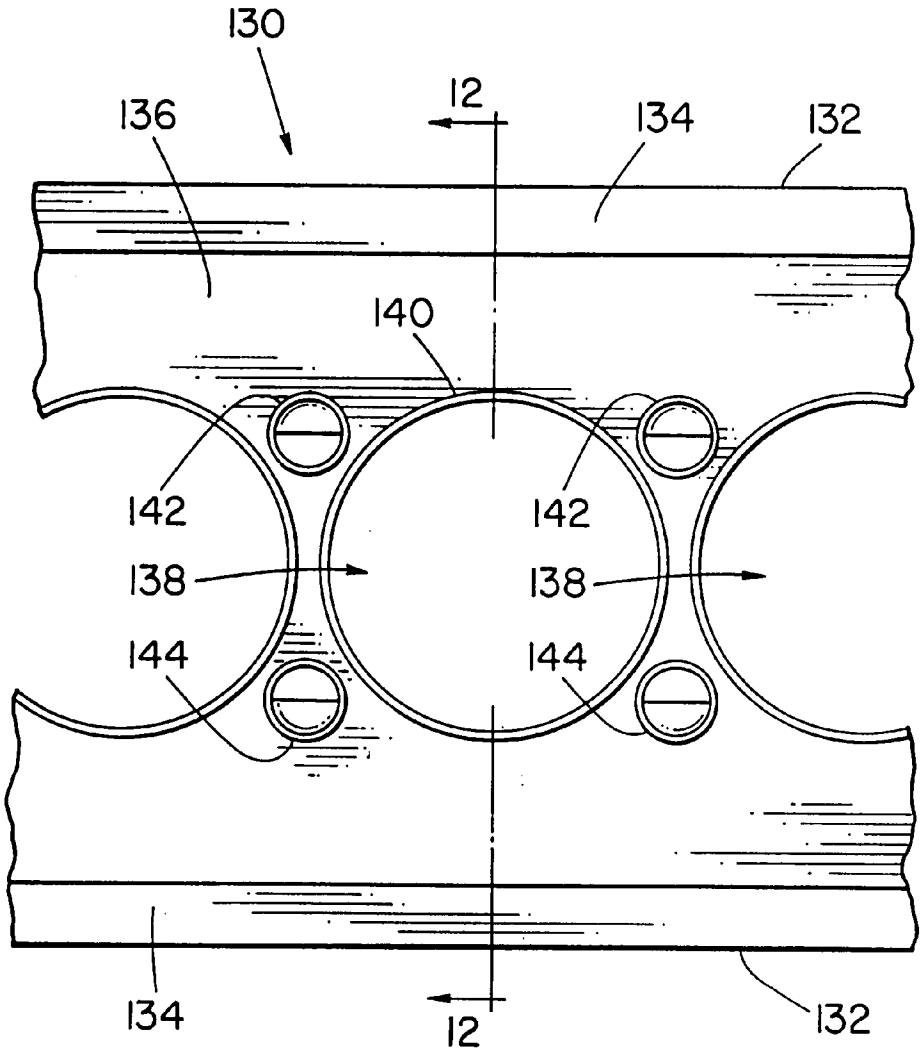
FIG. 11 is a side elevation of one embodiment of a general purpose stud.

FIGS. 11 and 12 illustrate one form of general purpose stud 130. This is similar to the stud of FIGS. 2, 3, and 4 in many respects. The stud 130 has first and second right angular flanges 132—132, with first and second edge strips 134—134.

Between the flanges there is a web 136, formed with larger central non-triangular openings 138, with surrounding flanges or ring-walls 140, as before. Depressions 142 are formed adjacent the openings 138 and have openings 144.

The stud 130 can be used for general construction, and can be made wider, or of heavier gauge metal, to suit many different applications.

Figure 14:
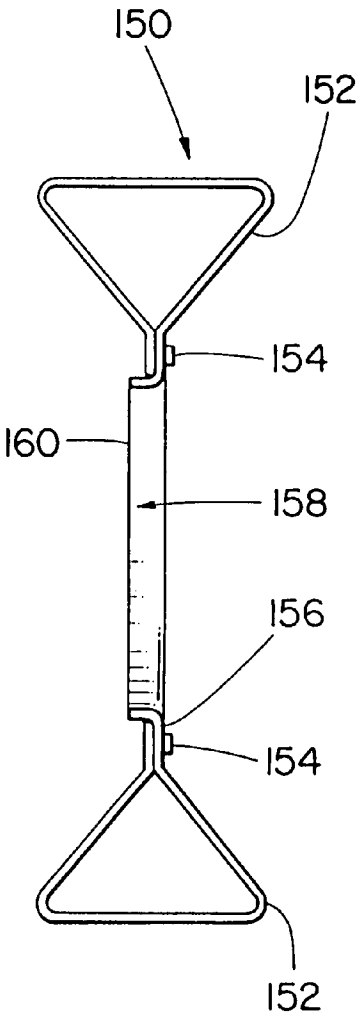
FIG. 14 is a section of the embodiment of FIG. 13.
Figure 13:
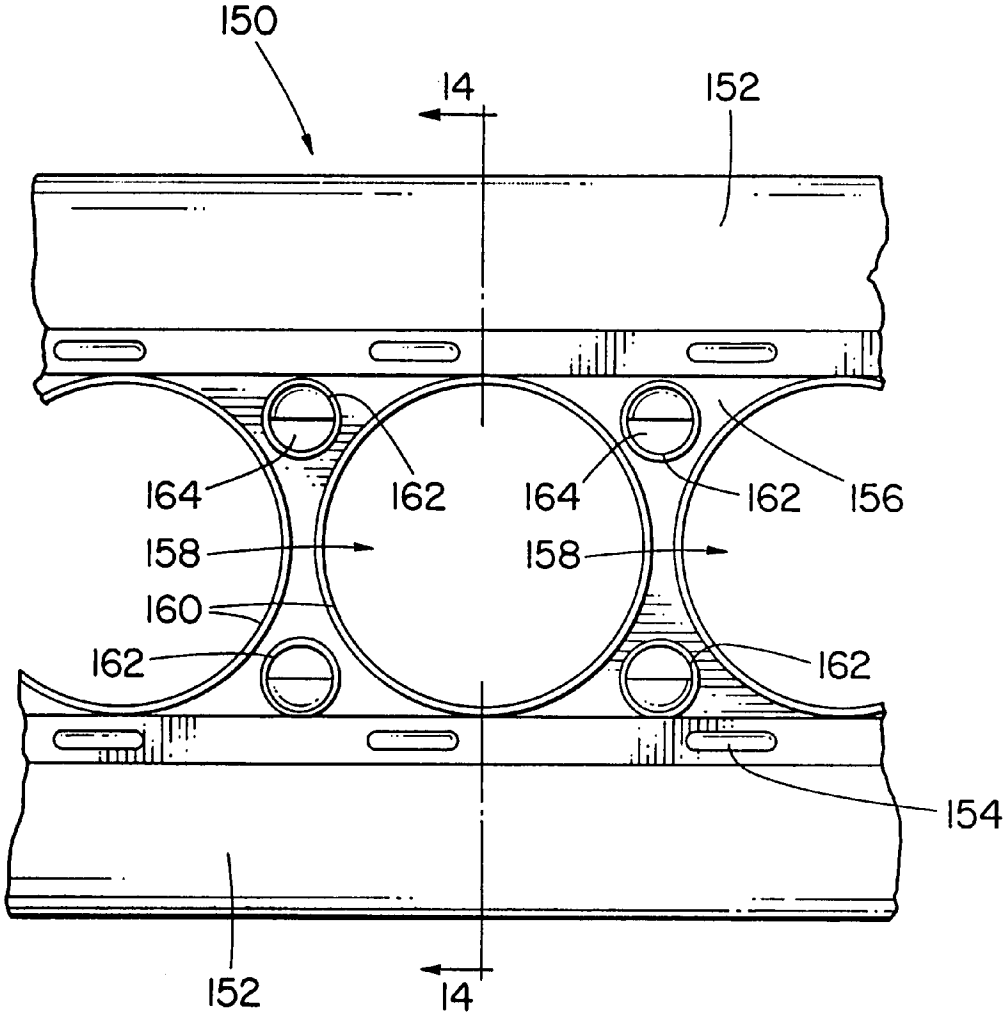
FIG. 13 is a side elevation of another embodiment of general purpose stud, suitable for heavier duty applications.

FIGS. 13 and 14 show a general purpose stud or beam 150 similar in many respects to FIGS. 5 and 6. The stud or beam 150 has first and second triangular tube formations 152—152, formed as before, with first and second fastenings 154—154.

Between the tube formations 152 there is a web 156, formed with larger central non-triangular openings 158, with annular flanges 160, as before. Depressions 162 are formed adjacent the openings 158 and have openings 164 with flanged edges.

The stud or beam 150 can be used for general construction, and can be made wider, or of heavier gauge metal, to suit many different applications.

Various modifications may be made in certain circumstances, which may either facilitate manufacture of the studs, or may improve their strength, or may achieve both advantages in some cases.

Figure 15:
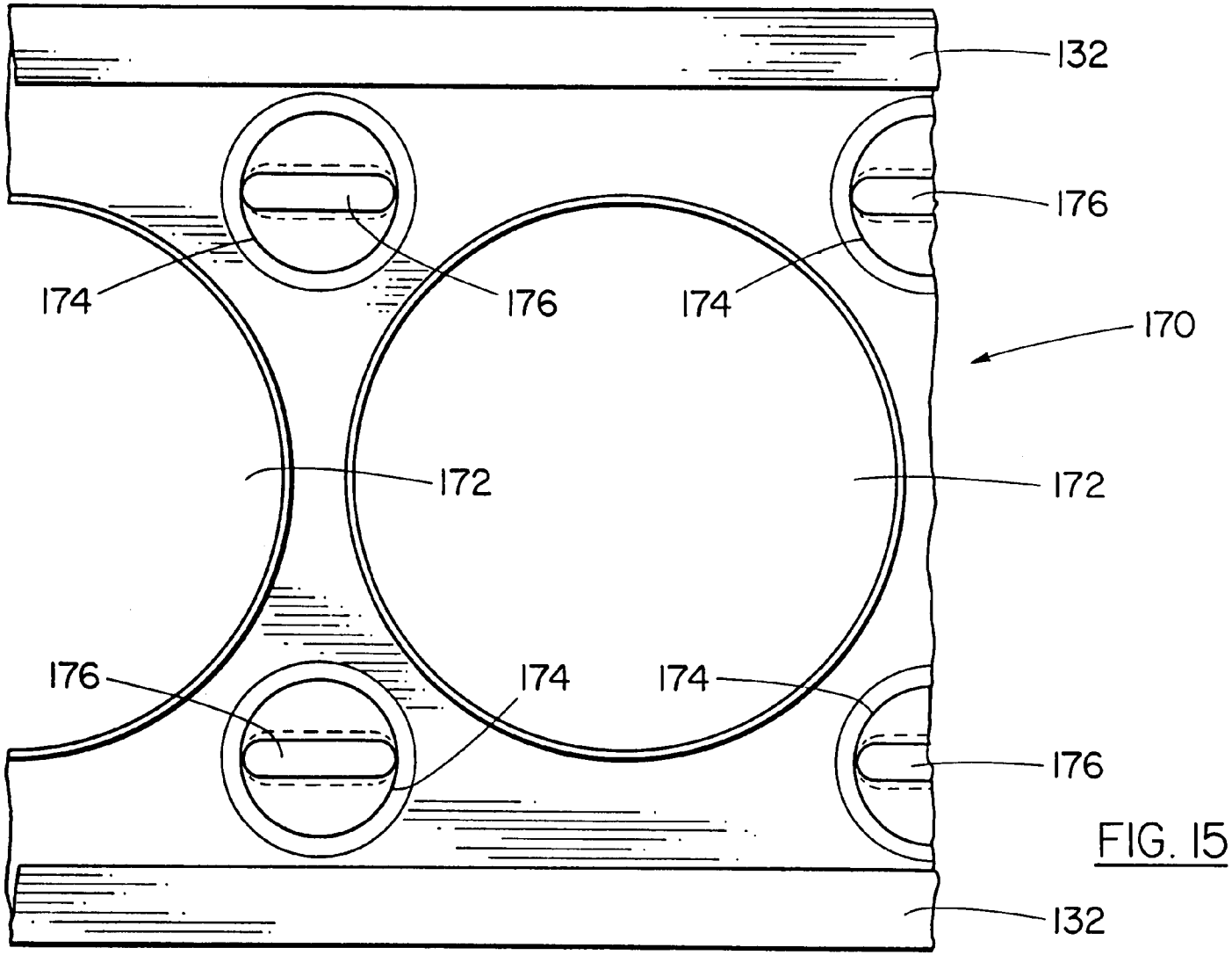
FIG. 15 is a side elevation of a further embodiment of stud in which the small circular indentations are formed with slotted openings.
Figure 17:
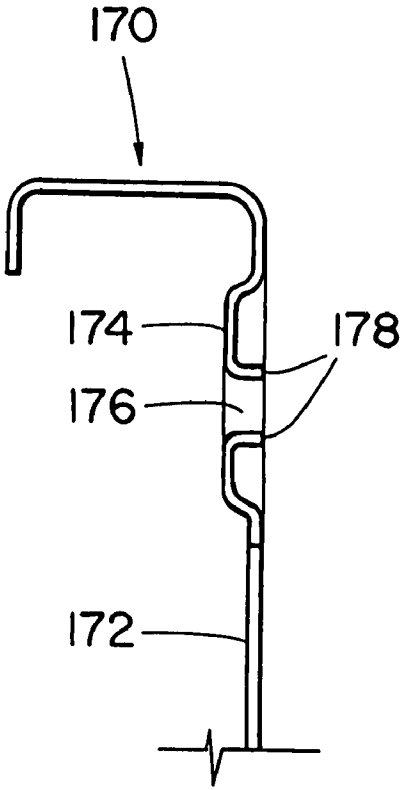
FIG. 17 is a section along line 17—17 of FIGS. 15, and 16, showing the small indentation and the opening and flanges therearound.

Thus as shown in FIG. 15 a stud 170 may be made which is generally similar to those described above, having a non-triangular main opening 172 as described. However in this case the circular depressions 174 are formed with openings 176. Side edges 178 (FIG. 17) of the depression 176 are formed at an angle to the plane of the sheet metal in the depression, for added strength.

Such openings 176 provide a barrier to heat transfer through the stud, without materially reducing its strength.

Figure 16:
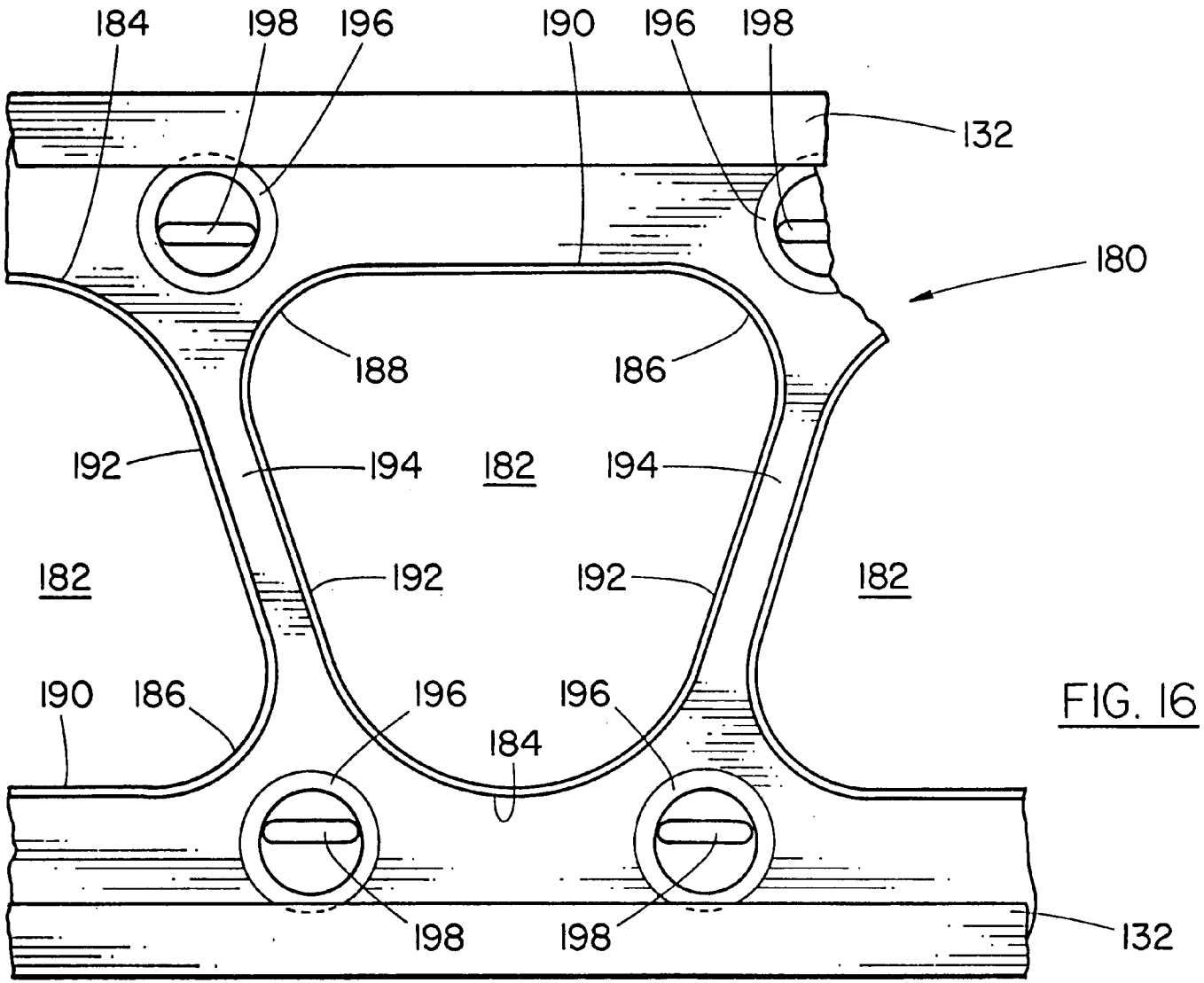
FIG. 16 is a side elevation of a further embodiment of stud in which the main openings are formed in a non-circular shape.

In other cases (FIG. 16) the stud 180 may be made with main openings 182 which are non-circular. Each opening 182 has one first corner 184 which is formed around an arc of a circle having a first radius, and has two further corners 186–188 which are formed around arcs having a radius less than the first corner 184. The main openings 182 thus define a linear base edge 190 and two linear side edges 192. The side edges 192 are angled more or less diagonally to the transverse dimension of the stud. The edges 192 define diagonal struts 194.

The main openings are arranged with their first corners 184 alternating in direction from one opening to the next, thus locating the struts 194 in a generally zig-zag pattern along the stud.

In this embodiment the circular depressions 196 are formed with openings 198 as described above, and formed as shown in FIG. 17.

Figure 18:
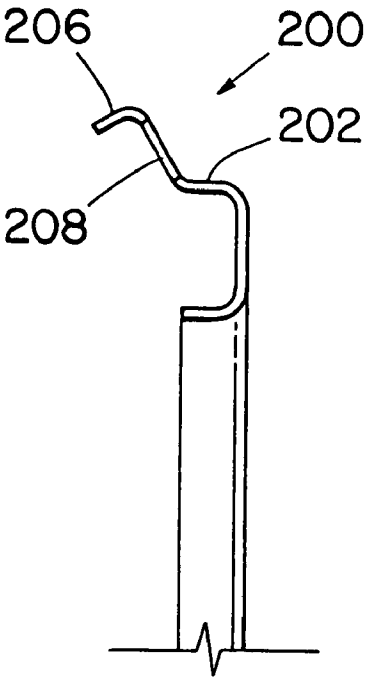
FIG. 18 is a section of an embedment flange suitable for any of the foregoing studs.
Figure 19:
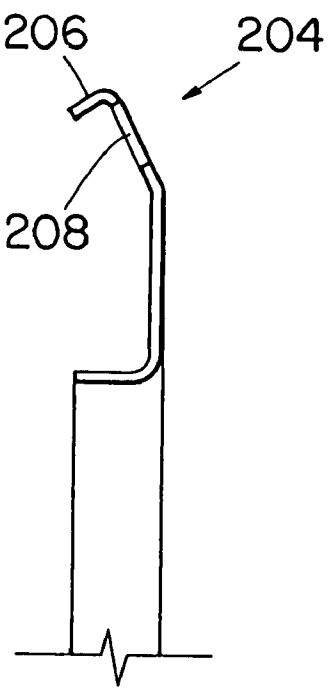
FIG. 19 is a section of an alternate form of embedment flange suitable for use on any of the foregoing studs; and, FIG. 20 is a section of a stud with a right angular flange having a folded strip forming a double thickness of sheet metal, suitable for use with the foregoing studs.

Any of the foregoing studs can be made with embedment flanges 200 (FIG. 18) Flanges 200 are formed on right angle bend portions 202. A further simplified embedment flange 204 is shown in FIG. 19 which is also suitable. In this case the embedment flange 204 is simply an edgewise extension of the web of the stud. In both cases locking portions 206 are bent over for embedment, and embedment openings 208 are formed at spaced intervals as described above.

Figure 20:
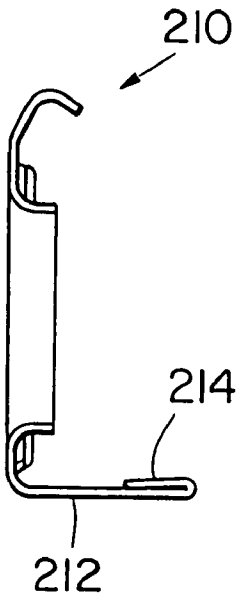

Many of the studs described can also be formed, as shown in FIG. 20, with a right angular flange having a folded strip. Stud 210 shown in FIG. 20 has the features already described above. However its right angle flange 212, has a free edge strip 214 which is folded back on flange 212 as shown. This will enhance the performance of the stud in many cases. It will also greatly facilitate the insertion of insulation between adjacent studs, in a wall. Such insulation may be in the form of batts. Or in many other cases the insulation may be in the form of blocks of cellular foamed styrene plastic. Such blocks are rigid and the use of studs having the folded strips 214 will be more suitable for insertion of such rigid blocks, than other forms of studs.

The foregoing is a description of a preferred embodiment of the invention as described. The invention comprehends all such variations thereof as come within the scope of the appended claims.

What is claimed is:

1. A steel stud suitable for use in construction of thermally efficient buildings and comprising;

a web defining two edges;

a first triangular tube formation formed on one said edge;

a second triangular tube formation formed on the other said edge;

web openings of generally non-triangular shape formed through said web between said first and second triangular tube formations;

edges of said openings being formed out of the plane of said web into generally right-angular flanges;

generally circular depressions formed in said web between said web openings and said triangular tube formations;

depression openings formed within said depressions, and reinforcing flange ring-walls formed around said depression openings.

2. A steel stud as claimed in claim 1 and wherein said web between said web openings defines generally hour-glass shaped web portions, which are narrower at about the mid point of said web.

3. A steel stud as claimed in claim 1 and wherein said web between said web openings defines generally transverse shaped web portions, which are narrower at about the mid point of said web, and wherein said depression openings are located adjacent each end of said narrower portions.

4. A steel stud as claimed in claim 1 for use in forming a composite construction panel wherein the panel is formed with a thin panel of cast material, and a reinforcing grid of sheet metal studs wherein said studs have embedment portions which are embedded in the cast panel; and wherein said steel stud includes, an embedment flange portion formed along one edge of said web;

a retention edge strip on said embedment flange portion formed out of the plane of said embedment flange portion: and, a plurality of spaced apart embedment flange openings formed in said embedment flange portion, said embedment flange portions being embedded in said panel.

5. A steel stud as claimed in claim 4 wherein said embedment flange portion is formed at an angle to said web and wherein said embedment flange openings are formed by a series of semi-arcuate openings located spaced apart lengthwise along said embedment flange portion.

6. A steel stud as claimed in claim 5 including flanges formed around said web openings.

7. A steel stud as claimed in claim 1 and wherein said triangular tube formations have a first angled tube wall, a second transverse tube wall, and a return tube wall; a free edge of said return tube wall being fastened to said web.

8. A steel stud as claimed in claim 1 wherein said web openings are of generally circular shape, and edges of said circular openings being formed out of the plane of said web, into a continuous annular ring.

* * * * *